US006984811B2

(12) United States Patent
Lee

(10) Patent No.: US 6,984,811 B2
(45) Date of Patent: Jan. 10, 2006

(54) DOOR FOR MICROWAVE OVEN HAVING INTEGRALLY FORMED CONTROL UNIT

(75) Inventor: Seung Ryong Lee, Changwon-shi (KR)

(73) Assignee: LG Electronics, Inc., Seoul (KR)

( * ) Notice: Subject to any disclaimer, the term of this patent is extended or adjusted under 35 U.S.C. 154(b) by 145 days.

(21) Appl. No.: 10/279,096

(22) Filed: Oct. 24, 2002

(65) Prior Publication Data

US 2003/0168447 A1 Sep. 11, 2003

(30) Foreign Application Priority Data

Mar. 11, 2002 (KR) ..... 2002-13058
Mar. 15, 2002 (KR) ..... 2002-14210
Mar. 15, 2002 (KR) ..... 2002-14212
Apr. 24, 2002 (KR) ..... 2002-22546

(51) Int. Cl.
*H05B 6/68* (2006.01)

(52) U.S. Cl. ..... 219/702; 219/720; 219/739; 219/756

(58) Field of Classification Search ..... 219/702, 219/720, 739, 756, 761, 717, 697, 701
See application file for complete search history.

(56) References Cited

U.S. PATENT DOCUMENTS 4,255,640 A * 3/1981 Bressler ..... 219/739
6,300,609 B1 * 10/2001 Kim ..... 219/702
6,515,266 B2 2/2003 Nasu et al.
6,539,840 B2 * 4/2003 Choi et al. ..... 99/331
2001/0009256 A1 * 7/2001 Nasu et al. ..... 219/739

FOREIGN PATENT DOCUMENTS

JP 63-127026 * 5/1988
JP 1-189422 * 7/1989 ..... 219/739
JP 2000-12209 * 1/2000

* cited by examiner

*Primary Examiner*—Philip H. Leung
(74) *Attorney, Agent, or Firm*—McKenna Long & Aldridge, LLP.

(57) ABSTRACT

A microwave oven includes a door. The door includes a door unit for selectively opening/closing a cooking chamber and a control unit, for controlling an operation of the microwave oven, is arranged at a predetermined part of the door unit.

16 Claims, 11 Drawing Sheets

DOOR FOR MICROWAVE OVEN HAVING INTEGRALLY FORMED CONTROL UNIT

This application claims the benefit of Korean Patent Application Nos. 2002-13058, filed on Mar. 11, 2002; 2002-14210, filed on Mar. 15, 2002; 2002-14212, filed on Mar. 15, 2002; and 2002-22546, filed on Apr. 24, 2002, which are hereby incorporated by reference for all purposes as if fully set forth herein.

BACKGROUND OF THE INVENTION

1. Field of the Invention

The present invention relates to a microwave oven, and more particularly, to a door for selectively closing a front surface of a microwave oven.

2. Discussion of the Related Art

Generally, microwave ovens such as those illustrated in FIG. 1 include a door 2 arranged on a front surface of the microwave oven body 1. Using a door handle 3, the door 2 may be used to open and close a cooking chamber provided within the body 1. Microwaves may be generated by various electrical devices accommodated in a device chamber provided in one side of the microwave oven body 1 and behind the controller 5.

Referring to FIGS. 1 and 2, the controller 5 further includes a control panel 6 provided as a frame of the controller 5. The control panel 6 generally includes, for example, a display portion 7*a* provided as a pass-through hole, a key portion 12 including a plurality of operation keys, operating buttons 13 and 13*a*, and the like. A key pad 11 is provided at a front surface of pass-through hole 7*a* and a display cover 8 is provided at a rear surface of pass-through hole 7*a*. Generally, both the key pad 11 and display cover 8 are formed of a transparent material.

Referring to FIG. 2, a substrate 10*a* is provided behind the control panel 6, opposite the pass-through hole 7*a*, and supports a display 10 (e.g., LED, LCD, VFD, etc.). As the display 10 is smaller in size than the pass-through hole 7*a*, a gap is formed between the two components. Accordingly, a display holder 9 may be arranged between the display cover 8 and the display 10 to fill a space created by the gap.

The key pad 11, provided on one region on the front of the control panel 6, shields the key portion 12, and includes printed information corresponding to different operation keys included within key portion 12. Accordingly, the printed information meaningfully defines, to a user, the operation each operation key may initiate. Return spring 13*s* allows for the operation of the operation button 13.

In the microwave oven illustrated in FIGS. 1 and 2, however, controller 5 is provided on one side of the microwave oven and in front of the device chamber. Disadvantageously, a portion of device chamber located between the various electrical devices and the controller 5 is inefficiently used and a portion of the front surface of the microwave body 1 is dedicated to the controller 5. Moreover, since the controller 5 is provided in front the device chamber, a user may operate the operation buttons 13 or the key part 12 when door 2 is opened. If a sensing device, capable of sensing whether the door 2 is open or closed, is out of order, a safety issue arises in that the open microwave oven may be operated by the user.

SUMMARY OF THE INVENTION

An advantage of the present invention, devised for solving the foregoing problems, provides a door of a microwave oven permitting efficient use of a space of the microwave oven.

Another advantage of the present invention provides a door capable of preventing wrongful operation of a microwave oven.

The foregoing advantages of the present invention may be achieved by providing a door on a microwave oven and a control unit arranged in a predetermined portion of the door. In one aspect of the present invention, the control unit enables a user to operate the microwave oven. In another aspect of the present invention, the door may, for example, include a door unit capable of selectively opening and closing a cooking chamber, wherein the control unit is arranged in a predetermined portion of the door unit.

In one aspect of the present invention, the door unit may include a door frame, wherein the door frame defines an exterior shape of the door, and a door panel arranged behind the door frame, wherein the control unit is arranged on the door panel. An opening having an inner perimeter contact part extended in front and rear directions may be provided in a predetermined portion of the door frame, wherein a portion of the door panel may be exposed through the opening in the door frame. In one aspect of the present invention, the door panel may further include a projection provided within the opening, wherein the projection may couple the door panel to the door fame.

In another aspect of the present invention, the projection on the door panel includes an outer perimeter contact part that corresponds to the inner perimeter contact part. For example, the inner perimeter contact part of the opening includes a contact part that may contact the outer perimeter contact part. A stepped part may be arranged behind the inner perimeter contact part to form a gap with the outer perimeter contact part.

In yet another aspect of the present invention, the door panel may include a protruding support part arranged behind the outer perimeter contact part, wherein the protruding support part may support a rear end of the stepped part of the door frame. The door panel may further include at least one joining rib, wherein the inner perimeter contact part may be inserted between the outer perimeter contact part and the joining rib.

In one aspect of the present invention, the door panel may include a seat, wherein the control unit may be arranged on the seat, a display portion for displaying information, and a back surface. An operation panel, provided with a plurality of buttons allowing a user to operate the microwave oven, may be supported by a front surface of the seat. A substrate, provided with a plurality of components enabling operation of the plurality of buttons and the display portion, may be supported on the back surface of the seat.

In one aspect of the present invention, the control unit may be electrically connected to a device chamber of a microwave via a connection cable included within the door of the microwave oven. Accordingly, the connection cable may connect the control unit to the device chamber via a lower portion of the door unit and a portion of a base plate of the microwave oven. The door may still further include a cover for covering a portion of the connection cable between door unit and the base plate, wherein the cover may have a height lower than a height of a leg arranged on the base plate.

In one aspect of the present invention, the cover may include a reception space and a door approach portion, wherein the reception space includes one opened side for receiving the connection cable and the door approach portion extends to one side of the reception space, thereby allowing the connection cable to pass through the door approach portion. In one aspect of the present invention, the door approach portion has a rounded exterior shape to prevent interference when the door is being rotated. In another aspect of the present invention, at least one holding rib may be provided in the reception space, wherein the holding rib secures the connection cable.

Thus, the foregoing door for a microwave oven of the present invention permits more effective use of a space of the microwave oven, and prevent wrong operation of the microwave oven.

DETAILED DESCRIPTION OF THE ILLUSTRATED EMBODIMENTS

Figure 3:
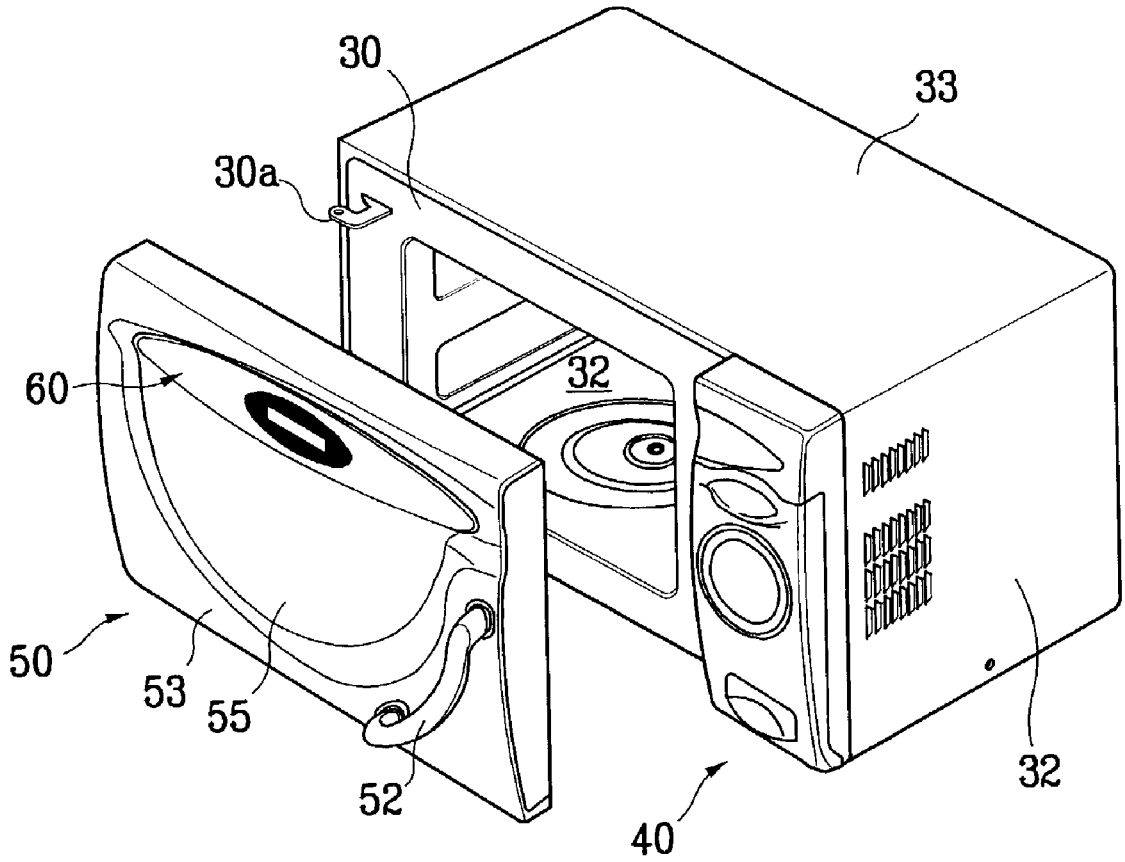
FIG. 3 illustrates a perspective view of a microwave oven in accordance with an embodiment of the present invention.
Figure 4:
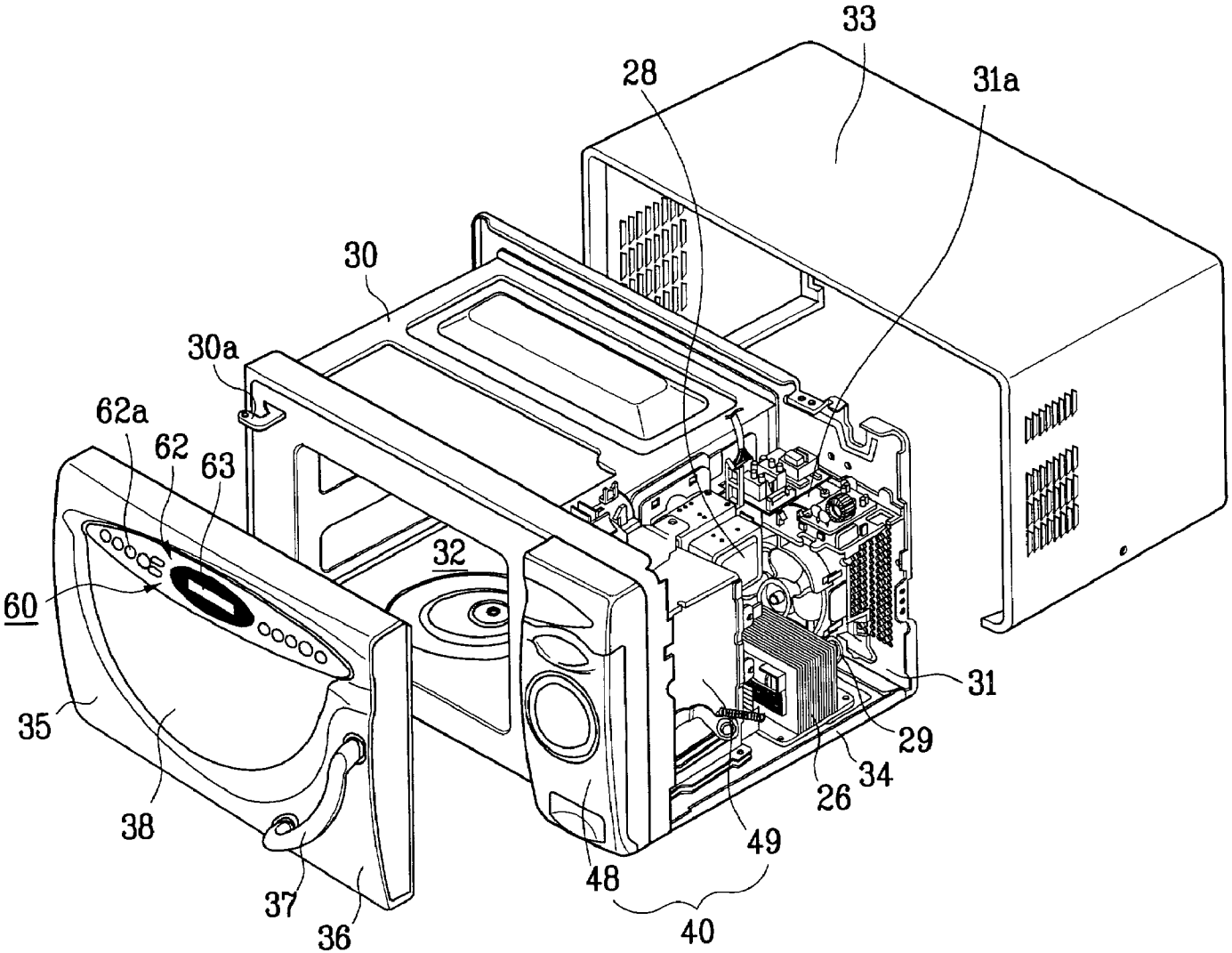
FIG. 4 illustrates an exploded perspective view of the microwave oven shown in FIG. 3.

FIG. 3 illustrates a perspective view of a microwave oven in accordance with an embodiment of the present invention. FIG. 4 illustrates an exploded perspective view of the microwave oven shown in FIG. 3.

Referring to FIGS. 3 and 4, a cooking chamber 32 is arranged within a cavity assembly 30 serving as a frame of the microwave oven and an electrical device chamber 31 is arranged adjacent the cooking chamber 32. An object (e.g., food) arranged within cooking chamber 32 may be heated by radiation (e.g., microwaves) generated by various electrical devices arranged within the electrical device chamber 31. The various electrical devices may include, for example, a magnetron 12 for generating microwaves, a high-voltage transformer 14 for supplying high voltage to the magnetron 12, a fan 16 for generating an air flow inside the electrical device chamber 31 thereby cooling the various electrical devices as they may become heated. Further, a device substrate 31*a* may also be provided within the electrical device chamber 31. A base plate 34 may be arranged at a bottom surface of the cavity assembly 30. An outer case 33 may cover the cavity assembly 30 and the electrical device chamber 31, thereby forming outside top and side exterior surfaces of the microwave oven.

Cooking chamber 32 may be opened or closed via door 50 attached to the microwave oven via hinge plate 30*a*. The cooking chamber 32 may be closed when door 50 contacts a front surface of the cavity assembly 30. A user may open or close the cooking chamber 32 using a door handle 52 provided on the door 50. The door may also include a control unit and a door unit, wherein the control unit transmits signals capable of operating the microwave oven (e.g., to produce microwaves at a predetermined power level for a predetermined amount of time) and displays the operational status of the microwave oven.

Figure 5:
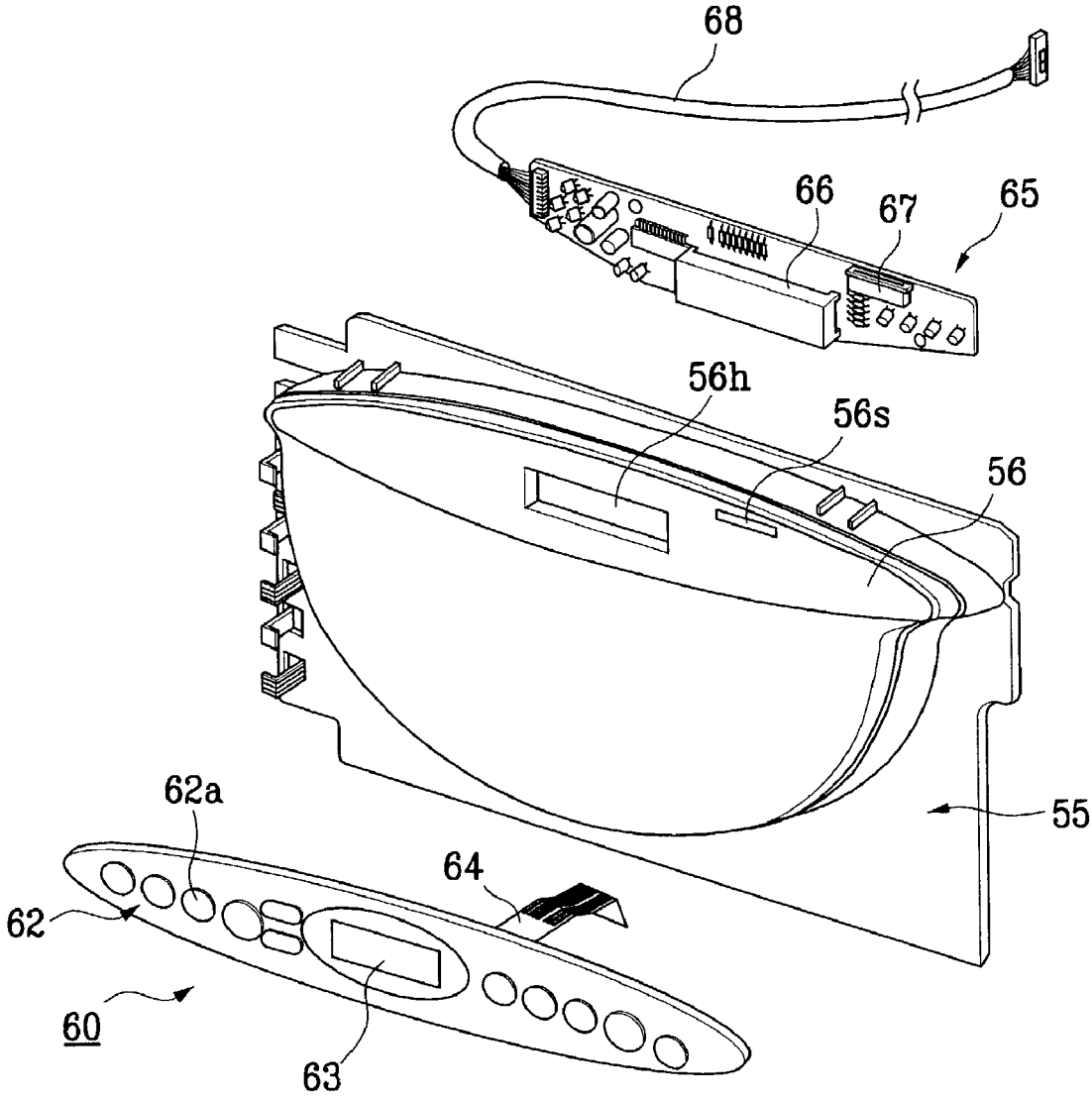
FIG. 5 illustrates an exploded perspective view of the door shown in FIG. 3.

Referring to FIGS. 3, 4 and 5, the door unit may, for example, include a door frame 53 forming the exterior surface of the door 50, and a door panel 55 arranged behind the door frame 53. In one aspect of the present invention, the control unit 60 may be provided on the door 50 via door panel 55.

An opening may be formed in an upper central portion of the door frame 53, through which a portion of the door panel 55 may project and thus be exposed. In one aspect of the present invention, the door panel 55 may be formed of a transparent material (e.g., transparent plastic) to enable a user to view the interior of the cooking chamber 32 from outside the microwave oven.

The control unit 60 may be provided at a predetermined position (e.g., an upper portion) on the door panel 55 and include an operation panel 62 and a substrate 65. The operation panel 62 may, for example, include a display portion 63, a plurality of buttons 62*a* enabling a user to operate the microwave oven, and a flexible cable 64 for transmitting signals between the buttons 62*a* and a plurality of components supported by substrate 65. Substrate 65 may, for example, support a display 66 for displaying information within the display portion 63, connectors 67 for electrically connecting to the flexible cable 64, and a connection cable 68 for electrically connecting the control unit 60 to the components in the electrical device chamber 31.

Control unit 60 may be seated on the door panel 55 via a seat 56. Seat 56 may be laterally arranged in, and project outwardly from, an upper portion of the door panel 55. A display portion pass-through hole 56*h* may be centrally arranged within seat 56 and a cable slot 56*s* may be arranged at a side portion of seat 56.

The operation panel 62 may be arranged on a front surface of seat 56, while the substrate 65 may be arranged on a rear surface of the seat 56. Once arranged on the seat 56, the location of the display portion 63 on the operation panel 62 corresponds to the location of the display portion pass-through hole 56*h* and the flexible cable 64 may extend through the cable slot 56*s* toward the back of the door panel 55 and connect to the connector 67 of substrate 65. Once assembled, information generated by display 66 may be shown through display part 63 and operation signals may be transmitted between the operation panel 62 and the substrate 65 via flexible cable 64 and connector 67.

Figure 1:
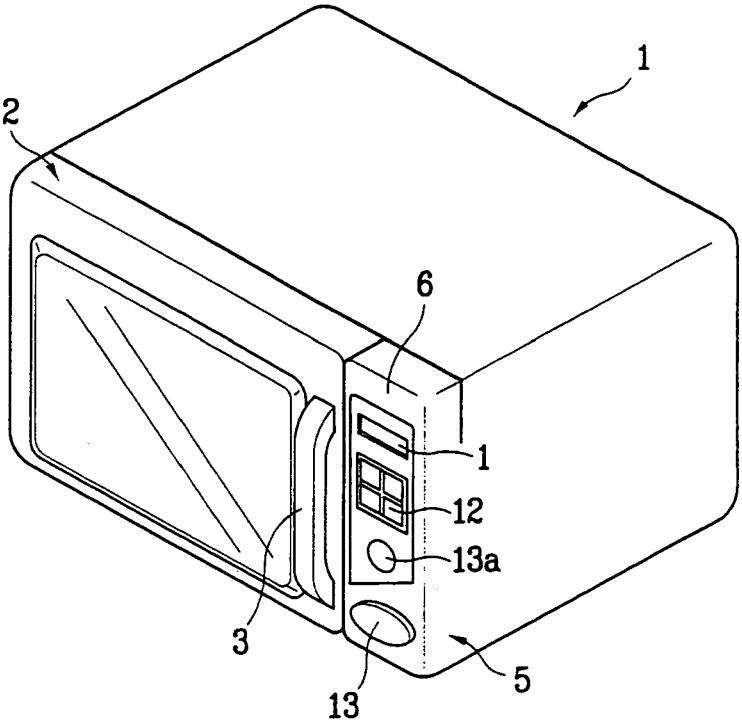
FIG.1 RELATED ART
FIG. 1 illustrates a perspective view of a related art microwave oven.
Figure 2:
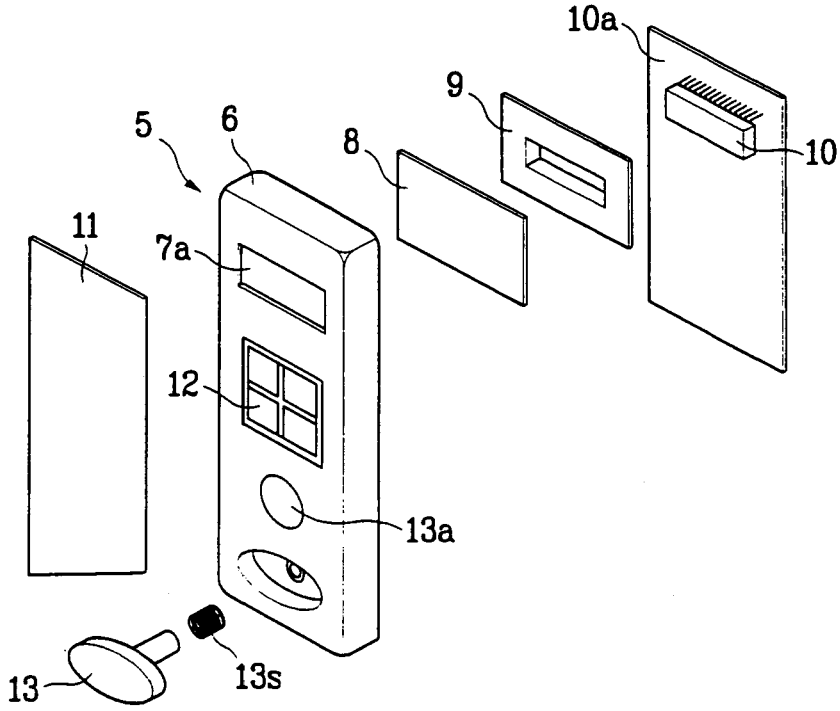
FIG.2 RELATED ART
FIG. 2 illustrates an exploded perspective view of the controller in FIG. 1.

According to the principles of the present invention, since control unit 60 may be arranged on the door 50, space located in a front portion of the electrical device chamber may be used for purposes generally not recognized by microwave ovens such as those illustrated in FIGS. 1 and 2.

For example, devices other than those used in the heating of objects with microwaves may be provided within the front portion of the electrical device chamber. Devices such as toasters, coffee makers, and the like, may be incorporated into the microwave oven of the present invention without increasing the size of the microwave oven. In one example shown in FIGS. 3 and 4, a toaster 40 may be arranged at the front portion of the electrical device chamber 31. Accordingly, a toaster body 49 may be arranged within the electrical device chamber 31 and a toaster door 48, for selective opening/closing the toaster 40, may be arranged at a front portion of the toaster body 49.

In order to operate the microwave oven according to the principles of the present invention, a user must, for example, press button 63*a* on the operation panel 62. In pressing button 63*a*, the user is required to apply a force to the operation panel 62. If the door 50 is opened, however, it is difficult to apply a force sufficient to press button 63*a* and therefore operate the microwave oven. Button 63*a*, however, may only be pressed with sufficient force when the door 50 is closed. Accordingly, the principles of the present invention may prevent the microwave oven from being operated when the door 50 is opened, either through the user or through a malfunction of a sensing device.

As mentioned above, connection cable 68 is located between and electrically connects, the control unit 60 and various electrical devices within the electrical device chamber 31. In the present invention, connection cable 68 may be guided along a coupling part of the door 50 and the body of the microwave oven, exposed at a lower part of the microwave oven, and inserted into the base plate 34. Accordingly, a portion of the connection cable 68 may be exposed to the outside at a location between the door 50 and the body of the microwave oven. Being exposed, the connection cable 68 may be vulnerable to damage (e.g., breakage).

Figure 6:
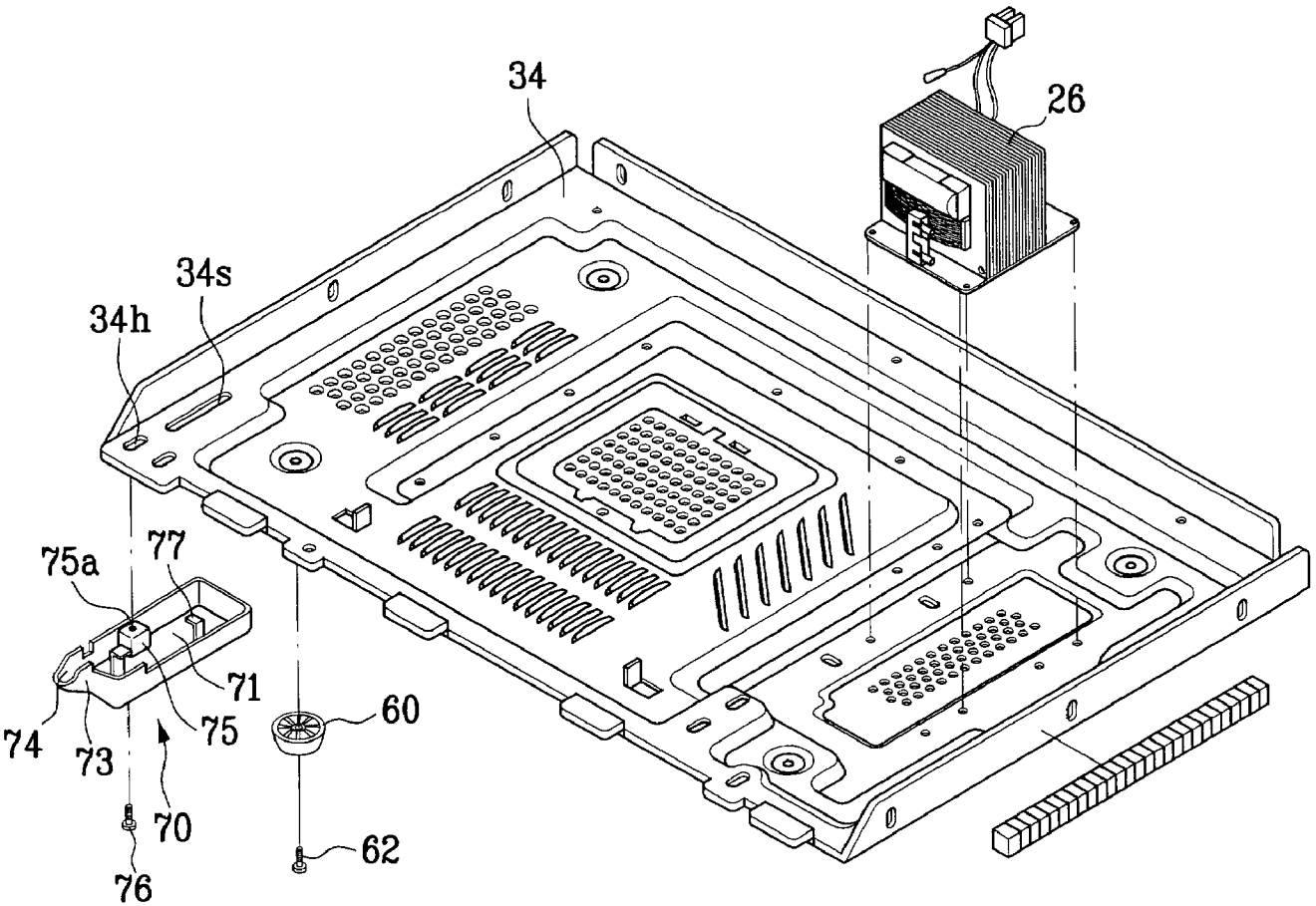
FIG. 6 illustrates an exploded perspective view of a portion of a microwave oven in accordance with another embodiment of the present invention.
Figure 7:
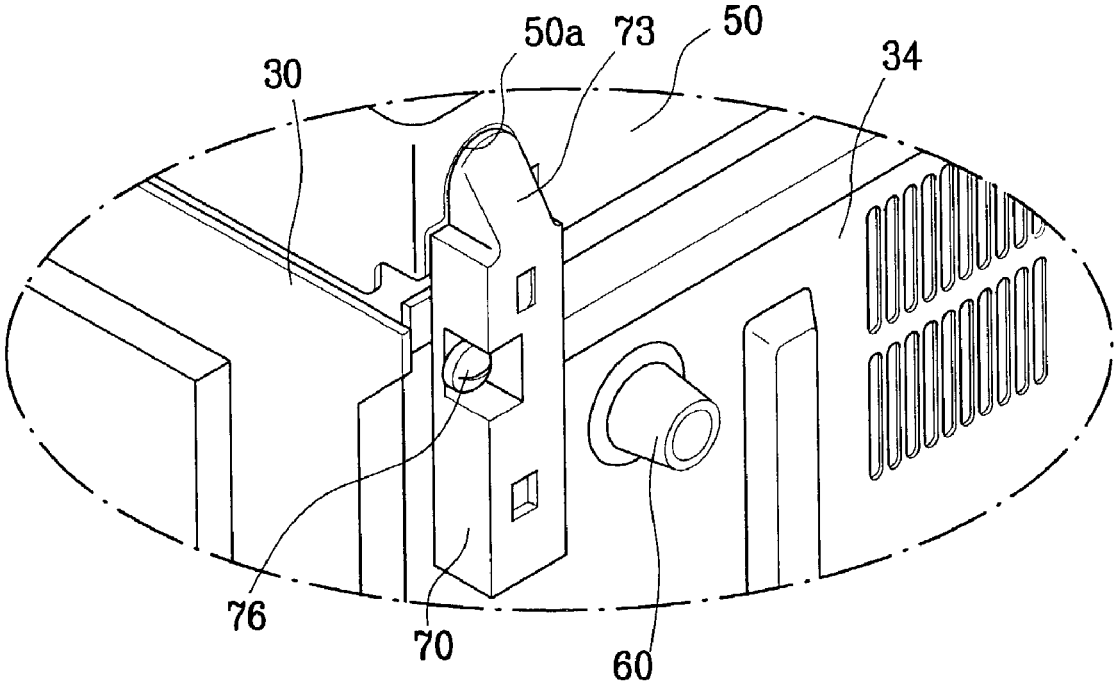
FIG. 7 illustrates a perspective view of microwave oven shown in FIG. 6.

With reference now to FIGS. 4, 6 and 7, the connection cable 68 may electrically connect the substrate 65 of the control unit 60 to substrate 31*a*, or other various electrical devices, within the electrical device chamber 31 or microwave oven in such a way as to minimize damage it could potentially incur.

In one aspect of the present invention, connection cable 68 may be guided from the substrate 65, through a cut-away portion 50*a* formed in a bottom surface of the door 50, through a pass-through hole 34*s* formed in base plate 34, and into the body of the microwave oven. According to the present invention, pass-through hole 34*s* may be arranged within a side portion of base plate 34 at the same side of the microwave oven as hinge plate 30*a*. The connection cable 68 may be arranged within the body of the microwave oven in a space defined between the outer case 33 and the cavity assembly 30.

The portion of the connection cable 68 that is exposed between the cut away part 50*a* in the door 50 and the pass through hole 34*s* in the base plate 34 may be covered with cover 70. In one aspect of the present invention, cover 70 may be hexahedral. In another aspect of the present invention, cover 70 may include a side arranged opposite the bottom of the base plate 34 is open such that cover 70 forms a reception space 71 capable of receiving the connection cable 68. Additionally, reception space 71 may include at least one holding rib 77 for holding the connecting cable 68. In one aspect of the present invention, holding rib 77 may exhibit a '⌉' form, substantially. In another aspect of the present invention, holding ribs 77 may be formed such that fore ends of the holding ribs are alternately extended in opposite directions.

In one aspect of the present invention, a door approach portion 73, extending toward door 50, is provided at one end of cover 70 located at the cut-away part 50*a* at the bottom of door 50. In another aspect of the present invention, the cut-away part 50*a* and the door approach portion 73 are rounded so as to minimize the degree to which the two components interfere with each other when the door 50 is opened and closed.

The door approach portion 73 includes a fore end having a connection cable lead-out opening 74. The connection cable lead-out opening 74 has an opened side formed to be in communication with an interior space of the door 50 at the cut-away part 50*a*.

The cover 70 includes a fastening rib 75 formed so as to project into the reception space 71 and be recessed in an exterior surface of the cover 70. Cover 70 may be secured to the base plate 34 by fastening a screw 76 to a fastening hole 34*h* in the base plate 34 through a fastening hole 75*a* arranged within fastening rib 75.

Legs 60 may be arranged at the bottom surface of, and coupled to, the base plate 34 to form a gap between the microwave oven and the surface on which the microwave oven is arranged. In one aspect of the present invention, the height of the gap between the microwave oven and the surface may be greater that the height of cover 70.

According to the principles of the present invention, the portion of the connection cable 68 located between door 50 and base plate 34 may be concealed by the cover 70. Thus, any damage that may be incurred by the portion of the connection cable 68 located between the door 50 and the body of the microwave oven may be minimized.

Figure 8:
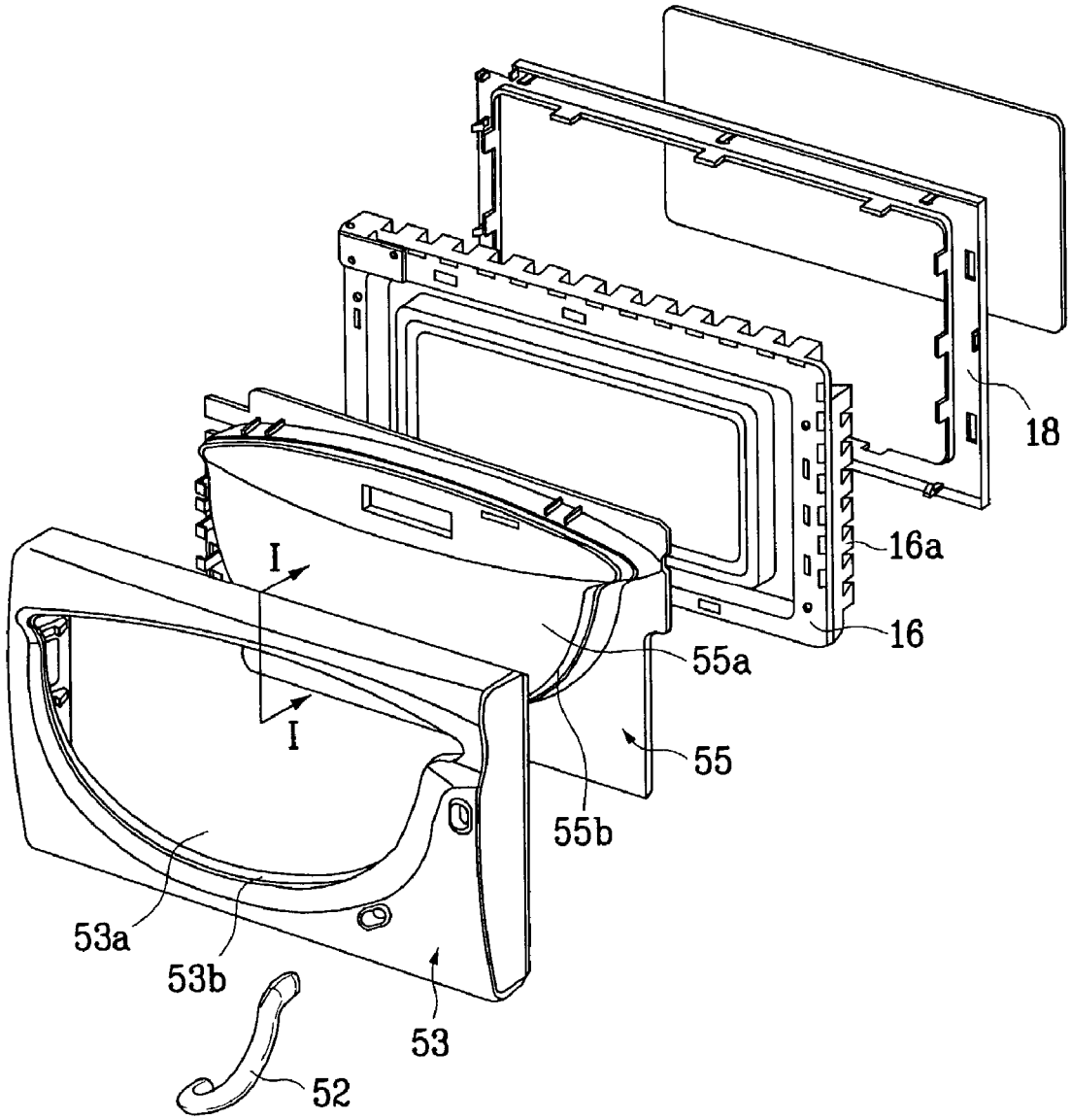
FIG. 8 illustrates an exploded perspective view of a door of a microwave oven in accordance with another embodiment of the present invention.
Figure 9:
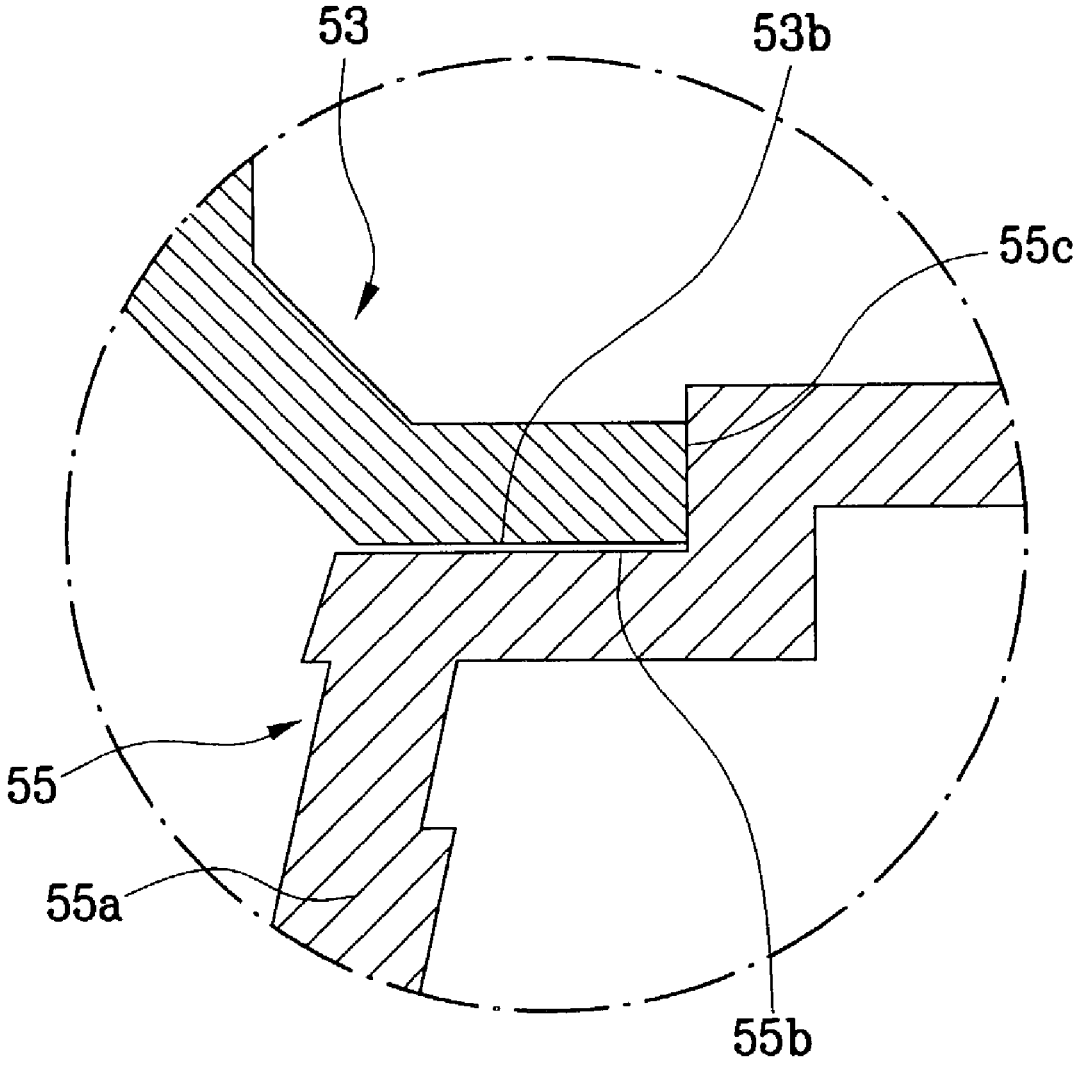
FIG. 9 illustrates a section view taken across a line I—I as shown in FIG. 8.

Referring now to FIGS. 8 and 9, door 50 according to one embodiment of the microwave oven of the present invention will now be explained.

As described above, the door 50 may include a door frame 53 and a door panel 55. A metallic frame part 16 forms a frame support structure for the entire door 50. A choke structure 16*a* may be provided at a rear edge of the metallic frame part 16 to prevent leakage microwaves generated within the cooking chamber 32. A cover 18 may be provided adjacent a rear edge of the choke structure 16*a*.

According to one aspect of the present invention, an opening 53*a*, defined by an inner perimeter contact part 53*b* extended in front and rear directions, may be formed in an upper central portion of the door frame 53, wherein the door panel 55 is coupled to rear of the opening 53*a*. A projected part 55*a*, defined by an outer perimeter contact part 55*b*, may be formed in door panel 55, wherein the projected part 55*a* may be inserted into the opening 53*a* of the door frame 53.

When the projected part 55*a* of the door panel 55 is inserted into the opening 53*a*, the inner perimeter contact part 53*b* and the outer perimeter contact part 55*b* are brought into contact.

Figure 10:
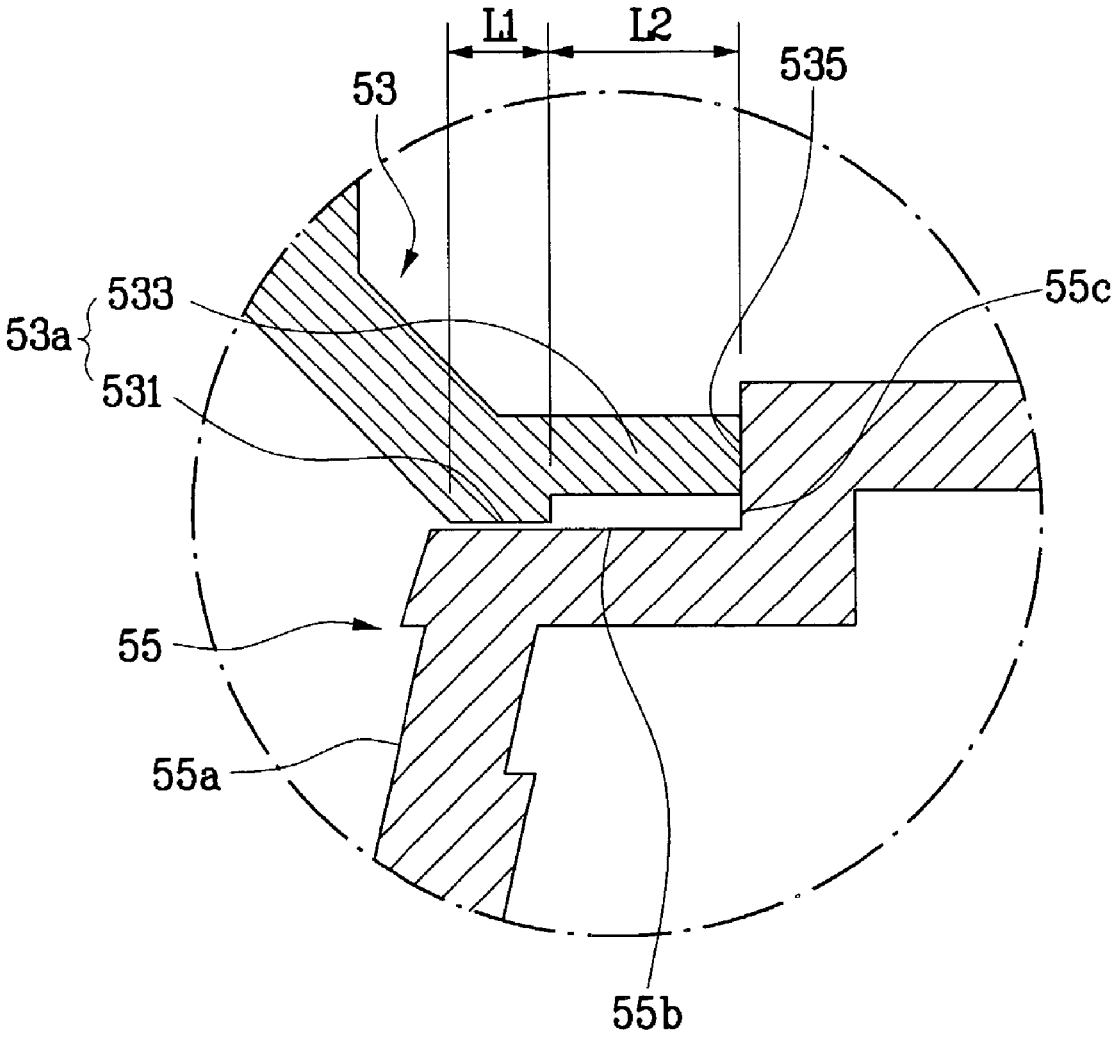
FIG. 10 illustrates a section view corresponding to one in FIG. 9, showing a variation.
Figure 11:
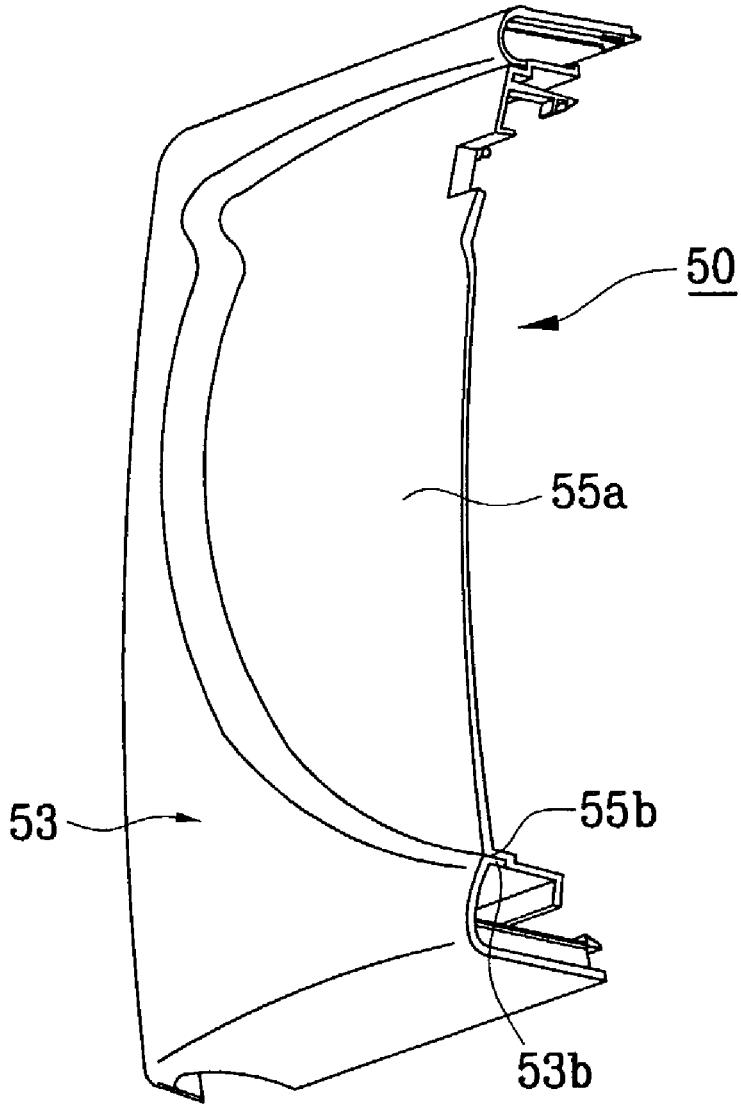
FIG. 11 illustrates a perspective partial cut-away view of a door of a microwave oven in accordance with another embodiment of the present invention.

Referring now to FIGS. 10 and 11, door 50 according to another embodiment of the microwave oven of the present invention will now be explained.

According to the present embodiment of the invention, the door frame 53 and the door panel 55 may be provided substantially as described with reference to FIGS. 8 and 9, however, the portions of the door frame 53 and of the door panel 55 that contact each other differ.

For example, while door panel 55 includes a projected part 55*a*, defined by the outer perimeter part 55*b*, to be inserted in the opening 53*a* of the door frame 53, door panel 55 further includes a support part 55*c* arranged behind the outer perimeter contact part 55*b* and extended in radial directions.

Additionally, while door frame 53 includes an opening 53*a* defined by the inner perimeter contact part 53*b*, the door frame 53 further includes a contact part 531, provided so as to contact the outer perimeter contact part 55*b*, and a stepped part 533, provided so as not to contact the door panel 55. In one aspect of the present embodiment, contact part 531 has a first length, L1, that is shorter than a second length, L2, of the stepped part 533.

Accordingly, when the projected part 55*a* of the door panel 55 is inserted into the opening 53*a*, the contact part 531 of the inner perimeter contact part 53*b* contacts, and is inserted into, the outer perimeter contact part 55*b* while the stepped part 533 does not contact the outer perimeter contact part 55*b* to form a gap therebetween. In one aspect of the present invention, a rear end 535 of the inner perimeter contact part 53*a* contacts the support part 55*c* of the door panel 55. Accordingly, the rear end 535 contacts the support part 55*c* and facilitates the door panel 55 to contact the door frame 53.

According to the present embodiment, in assembling the door frame 53 with the door panel 55, the first length, L1, of contact is shorter than the second length, L2, of no contact. Accordingly, the door frame 53 and the door panel 55 may be assembled after they come into contact over a comparatively short length, L1.

According to the present invention, the inner perimeter contact part 53*b* of the door frame and the outer perimeter contact part 55*b* of the door panel may be brought into contact in over a first length, L1. Therefore, assembly of the door frame 53 and the door panel 55 is simple, and any noise caused by contact between the two components after they are assembled may be reduced. Moreover, even if contact area between the two components is reduced, the contact of the rear end 535 with the support part 55*c* may provide a robust door assembly as the rear end 535 and the support part 55*c* make close contact even in an assembly state.

Figure 12:
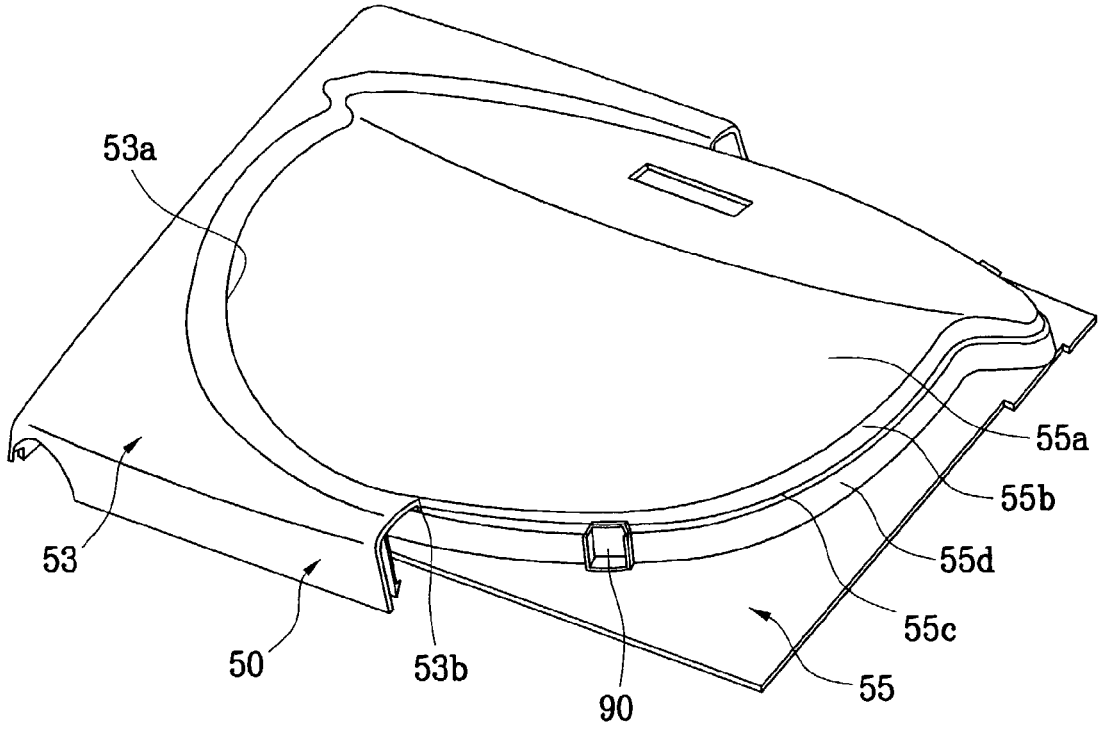
FIG. 12 illustrates a perspective partial cut-away view of a door of a microwave oven in accordance with another embodiment of the present invention.

Referring now to FIG. 12, door 50 according to yet another embodiment of the microwave oven of the present invention will now be explained.

According to the present embodiment of the invention, the door frame 53 and the door panel 55 may be provided substantially as described with reference to FIGS. 10 and 11, however, the present embodiment additionally includes a joining rib 90 for coupling of the door frame 53 to the door panel 55.

Accordingly, the door panel 55 includes a joining rib 90 projected forward from an outer surface of the support part 55*c*. The joining rib 90 extends forward from the outside outer perimeter surface 55*d* and backward from the support part 55*c* such that a gap is provided from the joining rib 90 to the outer perimeter contact part 55*b*. In one aspect of the present embodiment, a plurality of the joining parts 90 may be provided at predetermined intervals along the entire outer perimeter surface of the projected part 55*a*.

The door assembly of the present embodiment facilitates insertion of the inner perimeter contact part 53*b* between the joining ribs 90 and the outer perimeter contact part 55*b*. For example, when the door panel 55 is joined to the rear of the door frame 53, the inner perimeter contact part 53*b* is inserted between the outer perimeter contact part 55*b* and the joining ribs 90. Moreover, if a plurality of the joining ribs 90 are formed on an outer perimeter surface of the projected part 55*a*, the inner perimeter contact part 53*b* may be inserted between the joining ribs 90 and the outer perimeter contact part 55*b*.

According to the present invention, if an external force is applied to the door frame 53 or the door panel 55 after the two components are coupled together, the assembly of the door frame and door panel may be maintained. Moreover, the secure coupling of the door frame 53 and the door panel 55 prevents deformation of the door frame 53 or the door panel 55 due to heat generated inside the cooking chamber 32 and relative movement between the door frame 53 and door panel 55.

What is claimed is:

1. A microwave oven, comprising:

a cooking chamber;

a plurality of devices for generating radiation within the cooking chamber;

a door unit for selectively opening and closing said cooking chamber;

a control unit provided on said door unit, said control unit controlling an operation of the microwave oven;

a connection cable for electrically connecting said control unit to said plurality of devices, wherein said connection cable extends from a bottom surface of said door unit and into the body of the microwave oven;

an electrical device chamber adjacent said cooking chamber, said plurality of devices being arranged within said electrical device chamber;

a base plate beneath said cooking chamber; and a pass-through hole arranged within the base plate, wherein said connection cable extends into the body of the microwave oven via the pass-through hole such that a portion of said connection cable located outside said door unit is adjacent to said base plate.

2. A microwave oven as claimed in claim 1, further comprising a cover for covering said portion of said connection cable.

3. A microwave oven as claimed in claim 2, wherein the cover comprises:

a reception space, said reception space comprising one opened side for receiving the connection cable; and a door approach portion extending toward one side of said reception space, wherein said connection cable passes through said door approach portion.

4. A microwave oven as claimed in claim 3, wherein said door approach portion comprises a rounded outside shape.

5. A microwave oven as claimed in claim 3, further comprising at least one holding rib provided within the reception space for holding said connection cable.

6. A microwave oven as claimed in claim 2, further comprising a leg arranged at a bottom surface of said base plate, wherein said cover has a height smaller than a height of said leg.

7. A microwave oven, comprising:

a plurality of devices for generating radiation within a cooking chamber;

a base plate;

a pass-through hole arranged within the base plate;

a door unit for selectively opening and closing said cooking chamber, the door unit including a connection cable electrically connected to said plurality of devices, wherein a portion of said connection cable extends from a bottom surface of said door unit and along a bottom surface of said base plate and through said pass-through hole.

8. The microwave oven according to claim 7, further comprising a cover for covering said portion of said connection cable.

9. The microwave oven according to claim 8, wherein the cover comprises:

a reception space, said reception space comprising one opened side for receiving the connection cable; and a door approach portion extending toward one said of said reception space, wherein said connection cable passes through said door approach portion.

10. The microwave oven according to claim 9, wherein said door approach portion comprises a rounded outside shape.

11. The microwave oven according to claim 9, further comprising at least one holding rib provided within the reception space for holding said connection cable.

12. The microwave oven according to claim 8, further comprising a leg arranged at a bottom surface of said base plate, wherein said cover has a height smaller than a height of said leg.

13. A microwave oven, comprising:

a cooking chamber;

a door unit for opening and closing the cooking chamber;

a control unit on the door unit;

a plurality of devices for generating radiation within the cooking chamber; and a connection cable for electrically connecting the control unit to the plurality of devices, wherein a portion of the connection cable is below the door unit and a body of the microwave oven, and wherein the portion of the connection cable is not visible to a user when the cooking chamber is opened and closed by the door unit, wherein the cable passes through a bottom surface of the body of the microwave oven and a bottom surface of the door unit.

14. The microwave oven according to claim 13, further comprising a cover provided at the bottom surface of the body of the microwave oven, wherein the cover covers the portion of the connection cable.

15. The microwave oven according to claim 13, further comprising:

an electric device chamber adjacent to the cooking chamber, wherein the plurality of devices are accommodated within the electric device chamber; and an auxiliary cooking device provided within a front portion of the electric device chamber.

16. The microwave oven according to claim 15, wherein the auxiliary cooking device comprises a toaster.

* * * * *